US011078690B2

(12) United States Patent
Nagaoka et al.

(10) Patent No.: US 11,078,690 B2
(45) Date of Patent: Aug. 3, 2021

(54) DOOR LATCH APPARATUS WITH CHILDPROOF LOCK MECHANISM AND ASSEMBLING METHOD OF CHILDPROOF LOCK MECHANISM

(71) Applicant: MITSUI KINZOKU ACT CORPORATION, Kanagawa (JP)

(72) Inventors: Tomoharu Nagaoka, Kanagawa (JP); Hideaki Nozawa, Kanagawa (JP)

(73) Assignee: MITSUI KINZOKU ACT CORPORATION, Kanagawa (JP)

( * ) Notice: Subject to any disclaimer, the term of this patent is extended or adjusted under 35 U.S.C. 154(b) by 756 days.

(21) Appl. No.: 15/756,273

(22) PCT Filed: Aug. 3, 2016

(86) PCT No.: PCT/JP2016/072829
§ 371 (c)(1),
(2) Date: Feb. 28, 2018

(87) PCT Pub. No.: WO2017/145405
PCT Pub. Date: Aug. 31, 2017

(65) Prior Publication Data

US 2018/0245378 A1 Aug. 30, 2018

(30) Foreign Application Priority Data

Feb. 23, 2016 (JP) ..... JP2016-031654

(51) Int. Cl.
*E05B 77/26* (2014.01)
*E05B 79/08* (2014.01)
*E05B 83/36* (2014.01)

(52) U.S. Cl.
CPC ..... *E05B 77/26* (2013.01); *E05B 77/265* (2013.01); *E05B 79/08* (2013.01); *E05B 83/36* (2013.01);

(Continued)

(58) Field of Classification Search
CPC ..... E05B 79/08; E05B 77/26; E05B 77/265; E05B 83/36; Y10S 292/61; Y10T 292/1047; Y10T 292/1082
See application file for complete search history.

(56) References Cited

U.S. PATENT DOCUMENTS 225,728 A * 3/1880 Smith ..... E05B 63/127 292/191
5,092,638 A * 3/1992 Mizuki ..... E05B 77/265 292/216

(Continued)

FOREIGN PATENT DOCUMENTS

DE 19853056 * 5/2000
DE 10232095 A1 * 2/2004 ..... E05B 77/26

(Continued)

OTHER PUBLICATIONS

International Search Report, PCT/JP2016/072829, dated Sep. 20, 2016.

*Primary Examiner* — Carlos Lugo
(74) *Attorney, Agent, or Firm* — Nixon & Vanderhye

(57) ABSTRACT

Provide a door latch apparatus with a childproof lock mechanism that is only a projecting portion of the childproof lock mechanism is movable in the release direction interlocked with an opening operation of an inside lever, so that the degree of freedom of arrangement and design of several kinds of parts assembled in a housing can be increased. A release actuating member is supported movably in an elongated guide hole of a childproof lever from a standby position to a release position. When the childproof lever is in a childproof unlocking position and when an inside lever is carried out the opening operation, a projecting portion contacts to the inside lever and moves in the opening (Continued)

direction, so that the release actuating member moves to the release position against a biasing unit.

3 Claims, 14 Drawing Sheets

(52) U.S. Cl.
CPC ..... *Y10S 292/61* (2013.01); *Y10T 292/1047* (2015.04); *Y10T 292/1082* (2015.04)

(56) References Cited

U.S. PATENT DOCUMENTS 5,125,701 A * 6/1992 Hayakawa ..... E05B 77/265 292/336.3
5,762,383 A * 6/1998 Gomi ..... E05B 77/26 292/216
6,168,215 B1 * 1/2001 Kodama ..... E05B 81/06 292/201
6,343,817 B1 * 2/2002 Watanabe ..... E05B 77/30 292/201
6,382,686 B1 * 5/2002 Ishigaki ..... E05B 77/265 292/201
6,554,329 B1 * 4/2003 DeBlock ..... E05B 83/36 292/216
7,021,681 B2 * 4/2006 Hayakawa ..... E05B 83/36 292/216
7,543,861 B2 * 6/2009 Dupont ..... E05B 83/36 292/216
7,559,586 B2 * 7/2009 Fukunaga ..... E05B 81/06 292/201
8,267,444 B2 * 9/2012 Akizuki ..... E05B 81/16 292/201
10,352,069 B2 * 7/2019 Yamane ..... E05B 79/10
2002/0171250 A1 * 11/2002 Kobayashi ..... E05B 77/30 292/216

FOREIGN PATENT DOCUMENTS

EP 0637665 A1 * 2/1995 ..... E05B 77/26
EP 6376665 * 2/1995
EP 894924 A1 * 2/1999
EP 1004730 A1 * 5/2000 ..... E05B 77/265
FR 3014930 * 6/2015
GB 2313150 * 11/1997
JP 2-47368 3/1990
JP 10-121811 5/1998
JP 2000-303732 10/2000
JP 2002081247 A * 3/2002
JP 2006-037497 2/2006
JP 2009-030308 2/2009
JP 528831 4/2012
WO WO-2018145693 A1 * 8/2018 ..... E05B 77/283

* cited by examiner

DOOR LATCH APPARATUS WITH CHILDPROOF LOCK MECHANISM AND ASSEMBLING METHOD OF CHILDPROOF LOCK MECHANISM

BACKGROUND OF THE INVENTION

1. Technical Field of the Invention

The present invention relates to a door latch apparatus with a childproof lock mechanism and an assembling method of the childproof lock mechanism.

2. Description of the Related Art

Usually, a door latch apparatus provided in a rear door of a vehicle is equipped with a childproof lock mechanism which can change by manual operation a door opening operation of an inside handle provided in the vehicle to a childproof unlocking state where the door opening operation can be transmitted to a meshing mechanism which is engageable with a striker provided in a vehicle body side, or to a childproof locking state where the door opening operation cannot be transmit to the meshing mechanism.

For example, a child protector mechanism of a door latch apparatus disclosed in Japanese Patent No. 5,288,314 comprises a childproof lever (a childproof lock changing lever in Japanese Patent No. 5,288,314) that a manual operation part projected from an inner panel of a door and a projecting portion are formed integrally, where the projecting portion is allowed to be brought into abutment with an inside lever when it is in a childproof unlocking state and is not allowed to be brought into abutment with the inside lever when it is in a childproof locking state.

SUMMARY OF THE INVENTION

The childproof lever disclosed in Japanese Patent No. 5,288,314 is assembled to a straight-line guide portion oriented in the front-to-rear direction provided in a cover slidably and rotatably, and the projecting portion also moves in a release direction interlocked with an opening operation of the inside lever. Therefore, it is necessary to prepare a guide part and an escape hole for permitting rotation of the projecting portion in the cover, so that the structure of the cover is complicated and cost for manufacturing the cover is high. Moreover, since it is necessary to secure a space for the childproof lever and the projecting portion to rotate integrally inside the housing, the degree of freedom of arrangement and design of various parts such as the lever etc. incorporated in the housing, is restricted.

Furthermore, in recent years, in order to improve the assembly efficiency of the door latch apparatus, an automatic assembly is performed. However, according to the invention disclosed in Japanese Patent No. 5,288,314, since the childproof lever is assembled movably from the back of the cover in a straight-line guide portion (elongate groove) provided in the cover and oriented in the front-to-rear direction, the direction of assembling of the childproof lever differs from the direction of assembling several kinds of parts which are assembled in the housing from inner direction of the vehicle. Therefore, it is difficult to perform the assembly work of the childproof lever and the several kinds of parts automatically from the same direction in an assembly line etc., and this causes a decrease in assembly efficiency of the door latch apparatus.

In view of the above problems, it is an object of the subject invention to provide a door latch apparatus with a childproof lock mechanism and an assembling method of the childproof lock mechanism, enabling only the projecting portion to move in the release direction interlocked with the opening operation of the inside lever, so that make it possible to increase the degree of freedom of arrangement and design of various parts to be incorporated in the housing and to improve the assembly efficiency.

According to the present invention, the above-mentioned problems are solved as follows.

According to the 1st invention, there is provided a door latch apparatus with a childproof lock mechanism comprising: a housing whose opening surface on a vehicle inner side is covered by a cover; an inside lever operable in an opening direction in accordance with a door opening operation of an inside handle provided in the vehicle inner side; and a childproof lock mechanism that can be switched between a childproof unlocking state where an opening operation of the inside lever can be transmitted and a childproof locking state where the opening operation of the inside lever cannot be transmitted, wherein the childproof lock mechanism comprises: a childproof lever supported by the housing and rotatable to a childproof unlocking position and a childproof locking position; a release actuating member which is supported in a guide portion provided in the childproof lever movably from a standby position to a release position and has a projecting portion, wherein, when the childproof lever is in the childproof unlocking position, the projecting portion enters to a rotate locus of the inside lever in the opening direction, and when the childproof lever is in the childproof locking position, the projecting portion retreats from the rotate locus of the inside lever; and a biasing means always biasing the release actuating member toward the standby position, wherein the release actuating member is configured such that, when the childproof lever is in the childproof unlocking position and when the inside lever is in the opening operation, by the projecting portion is brought into abutment with the inside lever and is moved in the opening direction, the release actuating member moves to the release position against the biasing power of the biasing means.

According to the 2nd invention, in the above 1st invention, wherein the guide part is an elongated guide hole, wherein the release actuating member comprises: a guided shaft portion formed in the opposite side of the projection direction of the projecting portion and fitted movably in the elongated guide hole; a pair of flange parts facing each other across the guided shaft portion and sandwiching both sides of area where the elongated guide hole is formed in the childproof lever; and a spring receiving projection projecting to the counter direction of the projecting portion and on which one of foot pieces of a torsion coil spring is contacting by pressure as the biasing means.

According to the 3rd invention, there is provided an assembling method of the childproof lock mechanism for assembling the childproof lock mechanism according to the above 1st or 2nd invention to the housing of the door latch apparatus, the method comprising steps of: assembling the release actuating member to the guide part of the childproof lever and assembling the biasing means to the childproof lever and holding the release actuating member in the biased state in the standby position, thereby changing the childproof lock mechanism into a subassembly state; and assembling the childproof lock mechanism in the subassembly state to the housing.

According to the 4th invention, there is provided an assembling method of the childproof lock mechanism for assembling the childproof lock mechanism according to the above 1st or 2nd invention to the housing of the door latch apparatus, the method comprising steps of: assembling the release actuating member to the guide part of the childproof lever and assembling the biasing means to the childproof lever and holding the release actuating member in the biased state in the standby position, thereby changing the childproof lock mechanism into a subassembly state; assembling the childproof lock mechanism in the subassembly state to a shaft provided on a surface of the cover facing the housing, and assembling the childproof lock mechanism to the housing with the cover.

According to the present invention of the door latch apparatus with the childproof lock mechanism, since the release actuating member including the projecting portion is formed separately from the childproof lever, so that only the release actuating member containing the projecting portion is movable independently in the release direction in conjunction with the opening operation of the inside lever.

Therefore, there is no need to secure a space in the housing for rotating the projecting portion in the release direction with the childproof lever as in the prior art, and the degree of freedom of arrangement and design of various parts to be incorporated in the housing adjacent to the childproof lever is increased.

Further, according to the present invention of the assembling method of the childproof lock mechanism, since the childproof lever, the release actuating member, and the torsion coil spring constituting the childproof lock mechanism are assembled into a subassembly state beforehand, and then the childproof lock mechanism can be assembled to the housing from the same direction as the assembly direction of other parts, so that assembly efficiency of the door latch apparatus in an automatic assembly line etc. can be improved.

In the other method of the present invention that assembles the childproof lock mechanism changed into the subassembly state to the shaft on the cover, since at the same time as the cover is equipped with the housing, the childproof lock mechanism is also incorporable in the housing from the mounting direction of the cover, the assembly efficiency of the door latch apparatus can be improved.

DETAILED DESCRIPTION OF THE EMBODIMENTS

Figure 1:
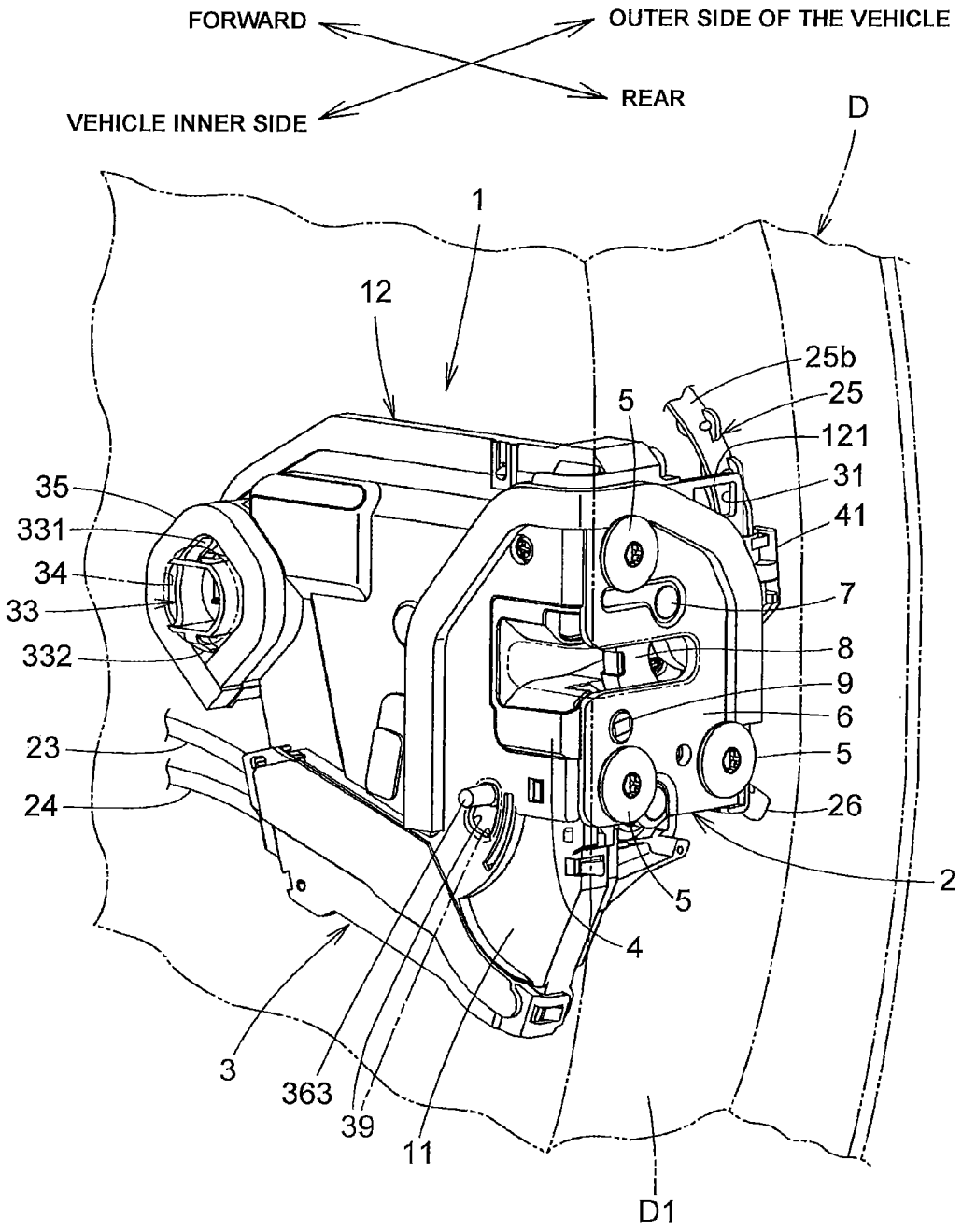
FIG. 1 is a perspective view of a door latch apparatus with a childproof lock mechanism according to the present invention, seen from a vehicle inner side.

Hereinafter, an embodiment of the present invention will be described with reference to drawings.

As shown in FIGS. 1 to 4, a door latch apparatus with a childproof lock mechanism (herein after, abbreviated as a door latch apparatus) 1 according to the present invention is, in a rear door (herein after, abbreviated as a door) D on the right-hand side of a vehicle, fixed to the rear end surface of an inner panel D1 of the door D, and comprises a meshing unit 2 for holding the door D in the closed state and an operation unit 3 combined with the meshing unit 2.

The meshing unit 2 comprises a box-shaped body 4 made of a synthetic resin with its rear surface is opened, and a metal cover plate 6 fixed to the rear surface of the body 4 for covering the opening surface of the body 4. The cover plate 6 and the body 4 are fixed to the rear end surface of the inner panel D1 in the door D with three bolts 5.

In the interior space between the body 4 and the cover plate 6, a meshing mechanism comprising a latch 8 and a pawl 10 is accommodated. The latch 8 is pivotally supported by a latch shaft 7 extending in the longitudinal direction and has a striker entrance groove 81 in which a striker S of the body side is engageable. The pawl 10 rotates with the pawl shaft 9 extending similarly in the longitudinal direction and prevents rotation of the latch 8 to the opening direction (the direction of cancelling engagement with the striker S).

The operation unit 3 comprises a housing 12 made of a synthetic resin and is fixed to the body 4 as a L character shape in a plane view, and an opening surface of the housing provided on the vehicle inner side is closed by a cover 11 made of a synthetic resin.

In the housing 12, following members are assembled; a lock/unlock motor 13 which rotates to forward-reverse direction and is accommodated in a front upper part of the housing 12;

a worm 14 fixed to a shaft of the lock/unlock motor 13 which is facing the rear of the motor 13;

a worm wheel 16 which is meshed with the worm 14 and is pivotally supported in the housing 12 by a shaft 15 facing the inward and outward of the vehicle;

a lock/unlock lever 18 pivotally supported in the housing by a shaft 17 facing the inward and outward of the vehicle and is rotatable to an unlocking position where enable opening the door D and a locking position where disable opening the door D;

a release lever 19 interlocked with the lock/unlock lever 18 and is rotatable to the unlocking position and the locking position;

an inside lever 21 of which an upper end part is pivotally supported by a shaft 20 facing the inward and outward of the vehicle provided on a lower back part of the housing 12, and is rotated to the opening direction (a clockwise direction in FIG. 4) when an inside handle (not shown) provided on the vehicle inner side of the door D is operated to open the door; and a childproof lock mechanism 22 which is pivotally supported by the same shaft 17 of the lock/unlock lever 18 so as to be close to the side surface of the lock/unlock lever 18 on the vehicle inner side, and is capable to change the door opening operation of the inside lever 21 into a childproof unlocking state where enable transferring the door opening operation to the release lever 19 and the pawl 10 of the meshing unit 2, or into a childproof locking state where disable transferring the door opening operation.

In addition, the cover 11 constitutes a part of the housing 12.

All member of the motor 13 on which the worm 14 is assembled, the worm wheel 16, the lock/unlock lever 18, the release lever 19, the inside lever 21, and the childproof lock mechanism 22 can be assembled in the housing 12, from the inner direction of the vehicle.

The upper part of the lock/unlock lever 18 is meshed with a tooth part (not shown) provided in the central part of outer side of the vehicle of the worm wheel 16. When the worm wheel 16 rotates forward-reverse rotation based on rotation of the motor 13, the lock/unlock lever 18 is automatically rotated to the unlocking position (the position shown in FIG. 4) where enable the opening operation of the door D by the outside handle and the inside handle (both are not shown) of the door, and to the locking position (a clockwise direction in FIG. 4) where disable the door opening operation. The lower end part of the lock/unlock lever 18 is connected to the other end part of an inner cable 23*a* of a first bowden cable 23 connected with a lock knob (not shown) one end of which is provided on the vehicle inner side of the door D. The lock/unlock lever 18 can be rotated also manually to the unlocking position and to the locking position, based on the unlocking operation and the lock operation of the lock knob.

On the upper part of the inside lever 21, an active opening portion 211 extending obliquely forward and upward is integrally formed (refer to FIG. 15), and the active opening portion 211 is capable of being brought into abutment with a projecting portion 371 of the childproof lock mechanism 22 mentioned later. The lower end part of the inside lever 21 is connected to the other end part of an inner cable 24*a* in a second bowden cable 24 one end of which is connected to the inside handle of the door D.

In the case that the lock/unlock lever 18 is in the unlocking position and the childproof lock mechanism 22 is in the childproof unlocking state, when the inside handle is operated to open the door and the inside lever 21 is rotated in the opening direction (a clockwise direction in FIG. 4), the active opening portion 211 of the inside lever 21 abuts with a projecting portion 371 of the childproof lock mechanism 22 from the lower side, then the release lever 19 is moved to an upper release position through a projecting portion 371, so that the engagement of the pawl 10 and the latch 8 is canceled and the door D can be opened.

At the back side (front side) of the body 4, an outside lever 26 and an outside sub lever 27 are pivotally supported by a shaft (not shown) respectively extended in the front-to-rear direction. The outside lever 26 is connected to the outside handle of the door through an inner cable 25*a* of a third Bowden cable 25, and rotates counterclockwise direction in FIG. 2 by an opening operation of the outside handle. The outside sub lever 27 is configured to link to the outside lever 26 and rotates clockwise direction in a rear view in conjunction with the rotation of the outside lever 26.

The end portion of the outside sub lever 27 on the vehicle inner side is connected to the above release lever 19, and when the lock/unlock lever 18 is in unlocking position, if the opening operation of the outside handle is carried out, the release lever 19 moves to the upper release position through the outside lever 26 and the outside sub lever 27, and the pawl 10 rotates in the direction that the pawl 10 being disengaged from the latch, then the door D can be opened.

Figure 2:
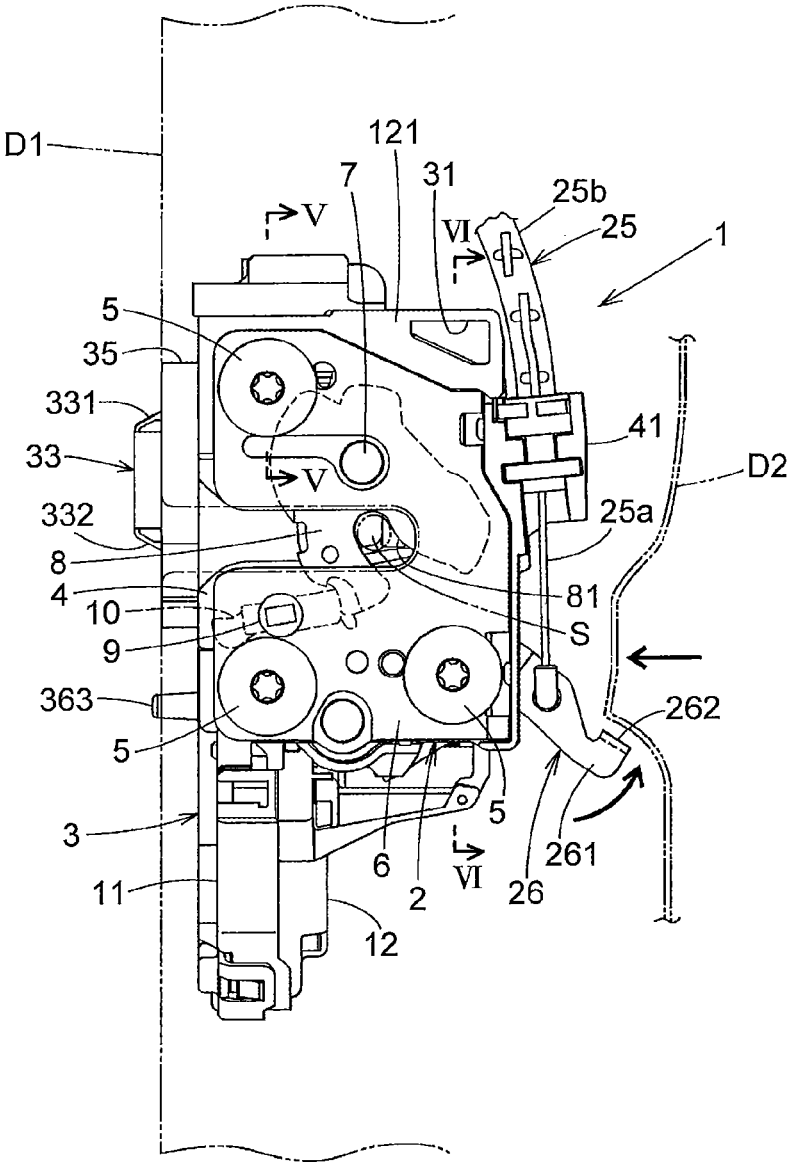
FIG. 2 is a rear view of the door latch apparatus with the childproof lock mechanism, seen from backside of the vehicle.

As shown in FIG. 2, the lower end part of an outer casing 25*b* of the third bowden cable 25 is fitted and held in a cable holder 41 so as not to be moved in the vertical direction, above the outside lever 26. The cable holder 41 is formed in the body 4 on the upper outer side of the vehicle, the rear surface of which is opened and is U character shaped in a plan view.

The lower end part of the inner cable 25*a* of the third bowden cable 25 is connected to a projecting portion of the outside lever 26 at a position close to one side of the meshing unit 2 on the outer side of the vehicle, and if the outside handle is operated for opening, the outside lever 26 is pulled in the opening direction (upper direction) so that the door is opened.

In the outside lever 26, an extending portion 261 which is extending to the outer side of the vehicle from the connection part of the inner cable 25*a* is formed. At the standby state when the outside handle is not operated for opening, one side part of the outside lever 26 including the extending portion 261 of outer side of the vehicle is inclined obliquely downward. A forward bent portion 262 facing forward is formed in the tip part of the extending portion 261.

According to this structure, that is, the side part of the outside lever 26 including the extending portion 261 of outer side of the vehicle is inclined obliquely downward, and the forward bent portion 262 is formed in the tip part of the extending portion, as shown in FIG. 2 with the two-point chain line, in a case, for example, when the outer panel D2 of the door D is deformed into the inner direction of the vehicle by a collision of the vehicle, etc., and if the deformed part enters into the rotation locus of the outer end side of the vehicle of the outside lever 26, the forward bent portion 262 will be located under the deformed part of the outer panel D2. Even if the outside lever 26 rotates in the opening direction (a counterclockwise direction) with inertia at the time of the collision, etc., since the forward bent portion 262 abuts with the undersurface of the deformed part of the outer panel D2. Therefore, the door D is prevented from being opened wide suddenly.

Figure 5:
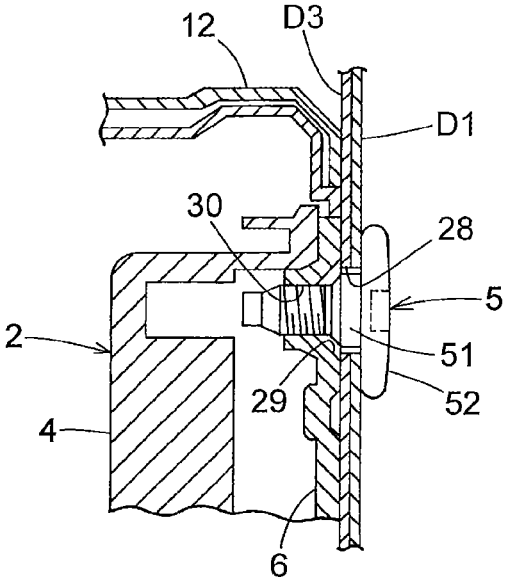
FIG. 5 is an enlarged sectional view taken along the line V-V of FIG. 2.

As shown in FIG. 5, the rear end portion of the inner panel D1 to which the cover plate 6 is fixed is reinforced by adhering a tabular reinforcement D3 to the inner surface (front surface) of the inner panel. In area of the inner panel D1 and the inner panel D1 where the cover plate 6 is fixed, three insertion holes 28 in which the axial part of the three bolts 5 mentioned above is inserted are bored respectively. The diameter of each insertion holes 28 is slightly larger than the diameter of a base shaft portion 51 of the bolt 5. In addition, each insertion hole 28 is a circular hole without any taper part projected toward the cover plate 6. There is no taper part also in the front part side of a head 52 of the bolt 5, and the head 52 is a disc-shaped with comparatively thin thickness.

In the state that door latch apparatus 1 is inserted into the door, overall of the door latch apparatus 1 is fixed to the rear end of the inner panel D1, by screwing and fastening each bolt 5 inserted in each insertion hole 28 of the inner panel D1 to each of a corresponding female thread hole 30 continuing with a taper hole portion 29 respectively provided in the cover plate 6. In addition, the diameter of the head 52 of the bolt 5 is larger than the diameter of the head of a bolt for general door latch device fixing, thereby the contact surface between the inner panel D1 and the head 52 is enlarged, so that the coupling strength of the cover plate 6 to the inner panel D1 is increased.

Figure 6:
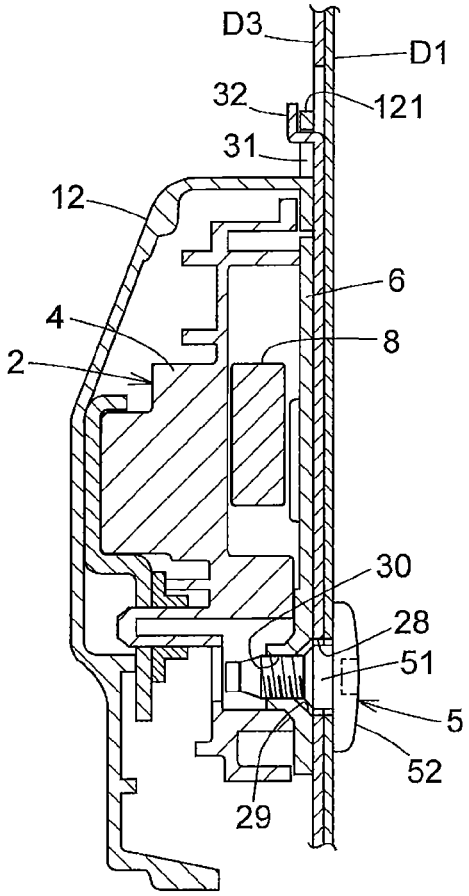
FIG. 6 is an enlarged sectional view taken along the line VI-VI of FIG. 2.

As shown in FIGS. 2 and 6, on the upper part of the cover plate 6 outer side of the vehicle of the housing 12, an upward projecting portion 121 is integrally formed, and in the upward projecting portion 121, an engaged hole 31 engageable to an engaging part 32 of the reinforcement D3 which mentioned later is provided. The opening of the engaged hole 31 is formed in the same direction (longitudinal direction) with the above-mentioned insertion hole 28.

On the other hand, in the reinforcement D3 in the inner panel D1, an engaging part 32 is provided by folding in an upward hook shape toward the front upper side so that it is engageable in the engaged hole 31. The engaging part 32 is integrally formed by cutting out a part of the reinforcement D3, for example. The engaged hole 31 and the engaging part 32 are formed in interrelated positions that is, when the engaged hole 31 is fitted to the engaging part 32, three female thread holes 30 of the cover plate 6 and three insertion holes 28 of the inner panel D1 are matched and can be positioned. In addition, for movable somewhat the door latch apparatus 1 to inside and outside the vehicle direction in the state the engaged hole 31 is engaged to the engaging part 32, the width size of the engaging part 32 of inside and outside the vehicle direction is smaller than the opening width of the engaged hole 31 of inside and outside the vehicle direction.

As shown in FIG. 6, when the engaging part 32 of the reinforcement D3 is fitted and engaged with the engaged hole 31 of the housing 12 in the door, while the rear surface of the cover plate 6 abuts with the front surface of the reinforcement D3, and three female thread holes 30 of the cover plate 6 and three insertion holes 28 of the inner panel D1 are matched respectively, the door latch apparatus 1 can be temporary held in the door in the state of suspended.

Figure 3:
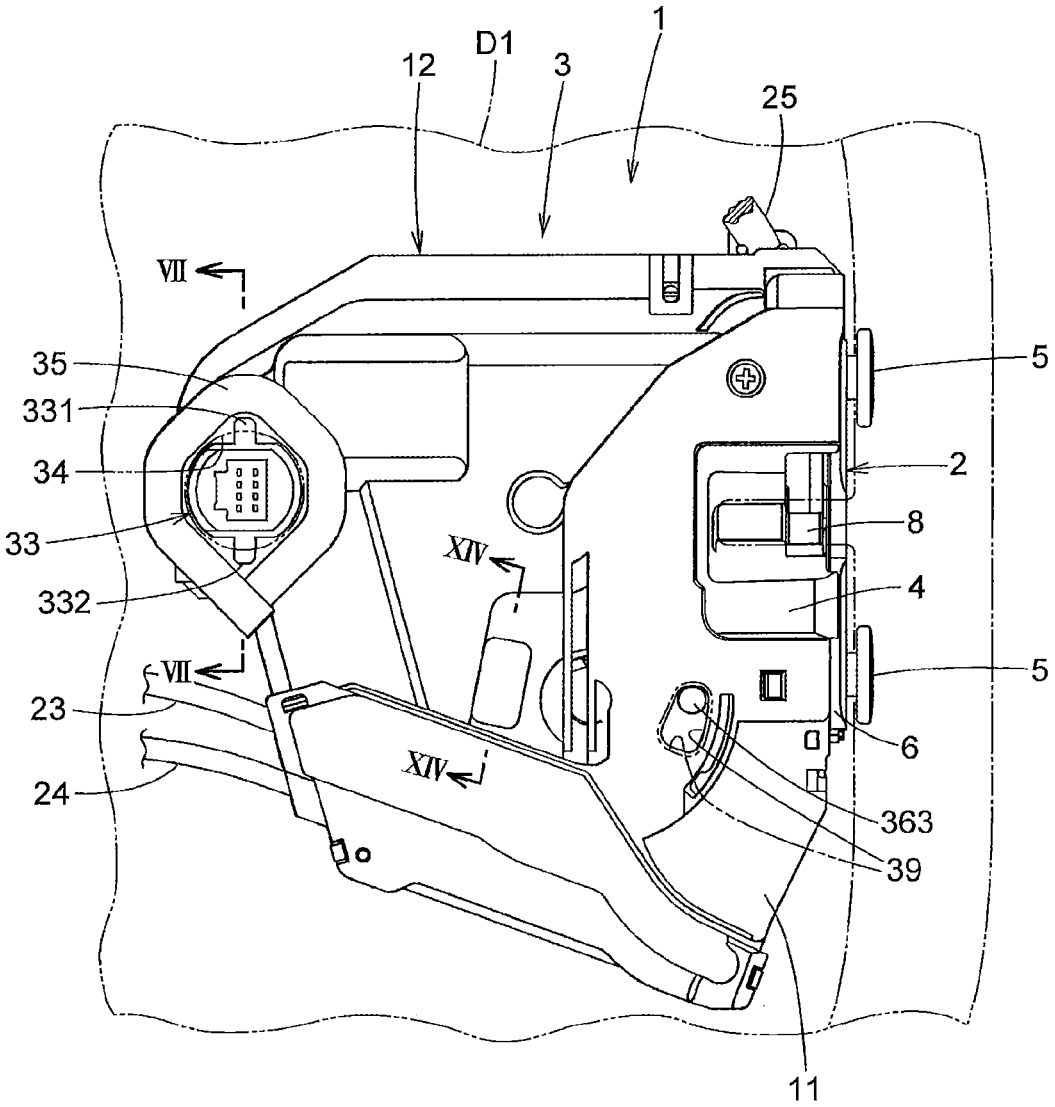
FIG. 3 is a side view of the door latch apparatus with the childproof lock mechanism, seen from the vehicle inner side.
Figure 7:
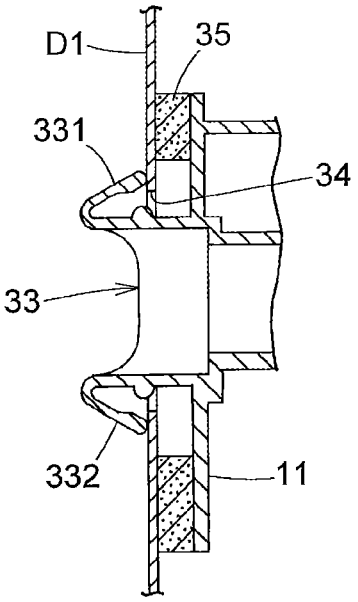
FIG. 7 is an enlarged sectional view taken along the line VII-VII of FIG. 3.

As shown in FIGS. 1, 3, and 7, at the front end of the side on the vehicle inner side in the cover 11, a cylindrical connector connecting portion 33 in which the upper surface and lower surface are flat is protruded integrally, so that it may face to the inner direction of the vehicle. A female-die connector (not shown) of the wire harness for supplying electric current to a motor in the housing 12, etc. is connected to this connector connecting portion 33.

On the upper flat surface of the connector connecting portion 33, an upper elastic engaging part 331 which is inclined obliquely upward from the tip of the connector connecting portion 33 on the vehicle inner side to the outer side of the vehicle is integrally formed, and on the under flat surface of the connector connecting portion 33, a lower elastic engaging part 332 which is inclined obliquely downward from the tip of the connector connecting portion 33 on the vehicle inner side to the outer side of the vehicle is integrally formed, respectively. The size in the back and forth direction of each of the upper elastic engaging part 331 and the lower elastic engaging part 332 is smaller than the width of the upper and lower flat surfaces of the connector connecting portion 33, and the length in the same direction is approximately a half of the projected size of the connector connecting portion 33. The upper elastic engaging part 331 can deform elastically downward and the lower elastic engaging part 332 can deform elastically upward, respectively.

In the inner panel D1 on the vehicle inner side, a circular open portion 34 in which the connector connecting portion 33 is fitted is formed. As shown in FIG. 7, in the state that an elastic seal material 35 is bonded on the side of outer side of the vehicle of the cover 11 so that the connector connecting portion 33 may be surrounded, if the connector connecting portion 33 is fitted to the open portion 34 from outer side of the vehicle, the upper elastic engaging part 331 is deformed elastically downward and the lower elastic engaging part 332 is deformed elastically upward, respectively.

When the upper elastic engaging part 331 and the lower elastic engaging part 332 are pushed further until they are passed through the open portion 34, the upper elastic engaging part 331 is elastically restored upward and the lower elastic engaging part 332 is elastically restored downward, respectively. By engaging both ends of outer side of the vehicle of elastic engaging parts 331, 332 to the opening edge on the vehicle inner side of the open portion 34, the connector connecting portion 33 is fixed so as not to come out from the open portion 34.

In addition, when pushing in the connector connecting portion 33, since the elastic seal material 35 is compressed a little, while the connector connecting portion 33 is prevented from moving to inside and outside the vehicle direction, and the sealability around the connector connecting portion 33 is maintained.

For assembling the door latch apparatus 1 of the above-mentioned embodiment in the door D, first, the door latch apparatus 1 is inserted into the door D through a work hole provided in the inner panel D1 on the vehicle inner side. Then while engaging the engaged hole 31 provided in the housing 12 of the door latch apparatus 1 to the engaging part 32 provided in the reinforcement D3 of the inner panel D1, fitting the connector connecting portion 33 provided in the cover 11 and the upper elastic engaging part 331 and the lower elastic engaging part 332 integrally formed with the connector connecting portion 33 to the open portion 34 provided in the inner panel D1 on the vehicle inner side, from outer side of the vehicle.

Thereby, mentioned as above, three female thread holes 30 of the cover plate 6 and three insertion holes 28 of the inner panel D1 can be matched. In this state, while the door latch apparatus 1 is temporary held in the door in the state of suspended, and the front end of the housing 12 is held by the inner panel D1 by the upper elastic engaging part 331 and lower elastic engaging part 332 in the connector connecting portion 33 of the cover 11 are engaged and are fixed to the opening edge on the vehicle inner side of open portion 34 so as not to come out. Since, the operator does not need to hold the door latch apparatus 1 with his one hand in the door, the screw fastening work of the bolt 5 can be easily done where his hands are released from the door latch apparatus 1, so that assembling workability and assembling efficiency of the door latch apparatus 1 into a door can be raised sharply.

Next, with reference to FIGS. 8 to 20, the composition and its action of the childproof lock mechanism 22 mentioned above are explained in detail.

As shown in FIGS. 8 to 13, the childproof lock mechanism 22 comprises: a childproof lever 36 made of a synthetic resin oriented in the front-to-rear direction and the front part of which is pivoted on the same shaft 17 of the lock/unlock lever 18 is supported and oriented in the direction of inside and outer side of the vehicle, a release actuating member 37 made of a synthetic resin assembled to this childproof lever 36, and a torsion coil spring 38 which is a biasing means always biasing the release actuating member 37 in a downward standby position.

The childproof lever 36 is in the shape of divergence toward back and in the front part of which a shaft hole 361 to be fitted to the shaft 17 of the housing 12 is formed. In the rear part of the childproof lever 36, a vertical auxiliary lever part 362 of small width is provided. One side in the vehicle outside of the auxiliary lever part 362 is combined with the childproof lever 36 in the side of the vehicle inner side at both of upper and lower ends, and the auxiliary lever part 362 is integrally formed with the childproof lever 36 so that the auxiliary lever part 362 is spaced a predetermined distance from the side of the childproof lever 36 in the vehicle outside.

On the side of the vehicle inner side of the upper part of the auxiliary lever part 362, a shaft shaped manual operation part 363 projected toward inner direction of the vehicle is integrally formed. The manual operation part 363 is projected to the vehicle inner side of the door penetrated vertical elongated holes 39, 39 formed in the cover 11 and the inner panel D1 on the vehicle inner side, as shown in FIGS. 1 and 3.

In addition, the manual operation part 363 is concealed by the vehicle body, when the door is closed, so that it is provided in the position where it cannot be operated from inside of the vehicle.

On the side of the vehicle inner side surrounding the shaft hole 361 in childproof lever 36, spring holding portions 364 and 364 for holding the torsion coil spring 38, and a locking projecting portion 365 by which one side foot piece 381 of the torsion coil spring 38 is locked is protruded. In back portion of the childproof lever 36, while the release actuating member 37 is fitted, a circular elongated guide hole 366 in which the release actuating member 37 can move centering on the shaft 17 based on the opening operation of the inside lever 21 is formed. In the upper part of the elongated guide hole 366, an enlarged diameter hole part 367 in which a small flange part 374 of the release actuating member 37 mentioned later can be inserted is continuously formed almost backward so that the elongated guide hole 366 may be followed.

Figure 8:
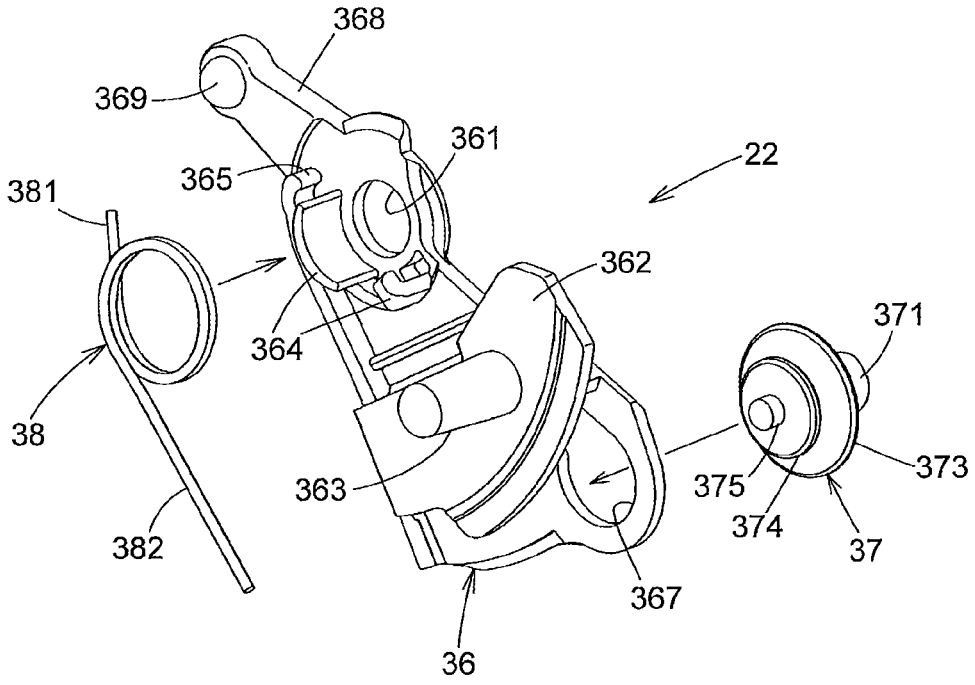
FIG. 8 is an enlarged perspective view of the childproof lock mechanism, before a spring and a release actuating member are assembled.
Figure 9:
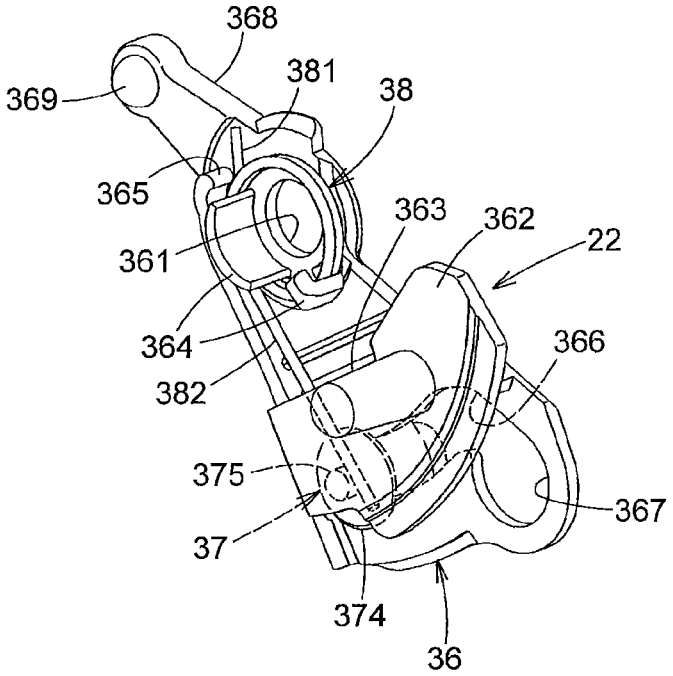
FIG. 9 is an enlarged perspective view of the childproof lock mechanism, after the spring and the release actuating member are assembled.
Figure 10:
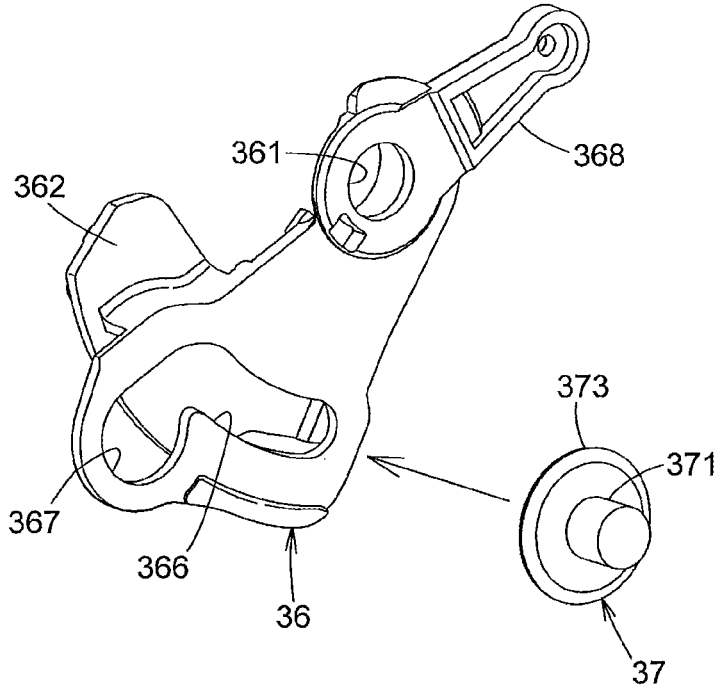
FIG. 10 is an enlarged perspective view of a childproof lever, seen from outside the vehicle, before the release actuating member is assembled.
Figure 11:
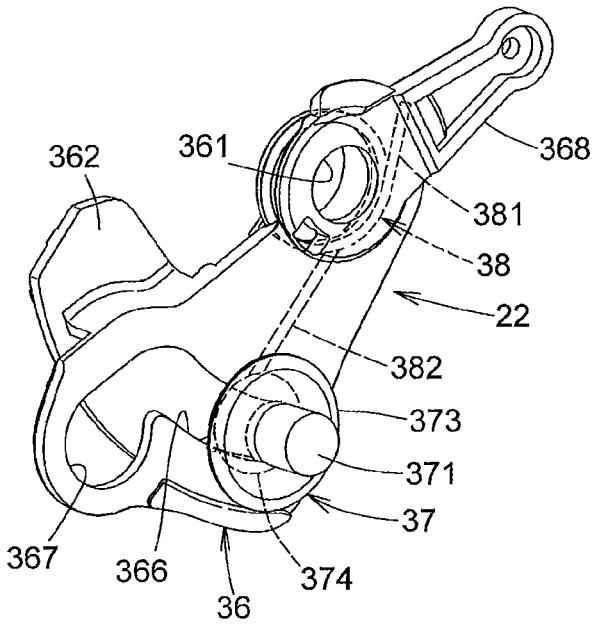
FIG. 11 is an enlarged perspective view of the childproof lever, seen from the outside the vehicle, after the release actuating member is assembled.
Figure 13:
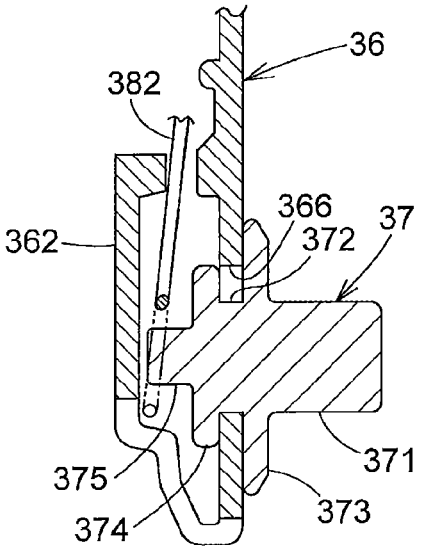
FIG. 13 is an enlarged sectional view taken along the line XIII-XIII in FIG. 12.

As shown in FIGS. 8 and 13, the release actuating member 37 comprises: a projecting portion 371 for release which is facing to the outer side of the vehicle; a guided shaft portion 372 which is formed on the vehicle inner side and is fitted slidably to the elongated guide hole 366 of the childproof lever 36; a pair of a large flange part 373 and a small flange part 374 each of which faces across the guided shaft portion 372; and a spring receiving projection 375 projecting inner direction of the vehicle which is the opposite direction to the projecting portion 371. An outer diameter of the small flange part 374 is that it can be inserted in the enlarged diameter hole part 367 of the childproof lever 36. The projection size of the spring receiving projection 375 to inner direction of the vehicle is the length that it does not contact with the inside of the auxiliary lever part 362 when the guided shaft portion 372 is fitted to the elongated guide hole 366.

Between the opposite surfaces of the large flange part 373 and the small flange part 374, a gap is formed which is little larger than the thickness of the childproof lever 36 near the elongated guide hole 366. So that, when the guided shaft portion 372 is fitted to the elongated guide hole 366, both sides of the childproof lever 36 around the area where the elongated guide hole 366 is formed are sandwiched between the large flange part 373 and the small flange part 374, and the release actuating member 37 can move smoothly along with the elongated guide hole 366.

The childproof lock mechanism 22 can be assembled beforehand assembling it to the housing 12, as follows. As shown in FIGS. 8 to 12, at first, in the enlarged diameter hole part 367 of the childproof lever 36, after inserting the small flange part 374 of the release actuating member 37 from the direction of the outer side of the vehicle, then the guided shaft portion 372 of the release actuating member 37 is fitted to the elongated guide hole 366 of the childproof lever 36, and the release actuating member 37 is moved to the lower end part along with the elongated guide hole 366 in advance.

Further, since, in the childproof lever 36, while the enlarged diameter hole part 367 which continuous with the elongated guide hole 366 is formed, in the release actuating member 37, the small flange part 374 which can be fitted to the enlarged diameter hole part 367 is provided, so that the release actuating member 37 can be easily assembled to the elongated guide hole 366.

Figure 12:
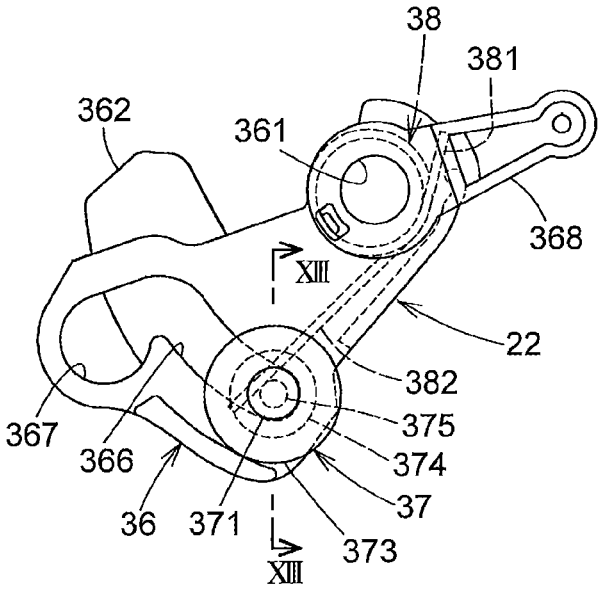
FIG. 12 is an enlarged side view of the childproof lock mechanism, seen from outside the vehicle.
Figure 15:
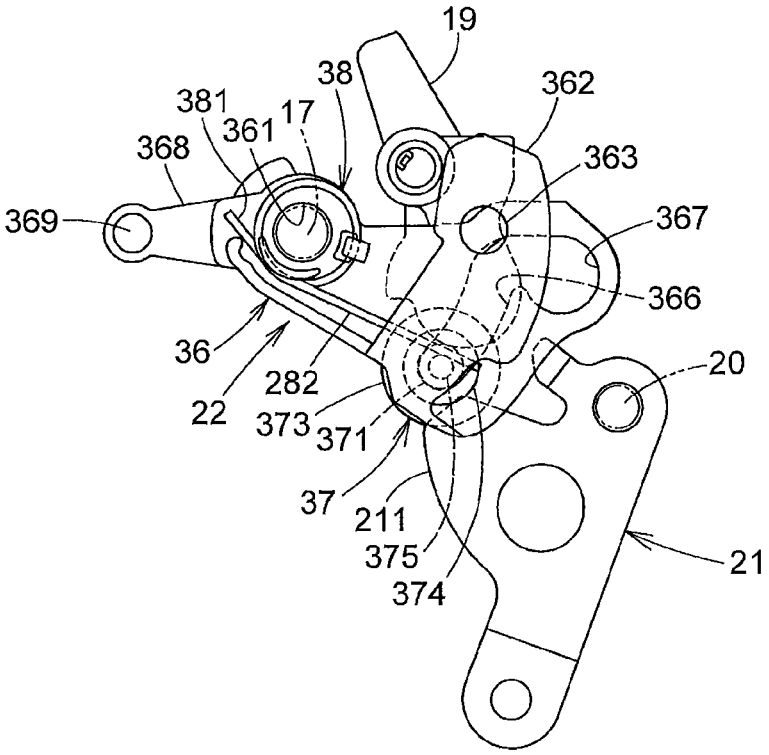
FIG. 15 is an enlarged side view of the childproof lever, an inside lever and a release lever, when the childproof lever is in a childproof unlocking state, seen from the vehicle inner side.

Next, the torsion coil spring 38 is held by the spring holding portions 364 and 364 of the childproof lever 36, and then, while the one side foot piece 381 of the torsion coil spring 38 is locked to the locking projecting portion 365 of the childproof lever 36, a tip part of the other side long-sized foot piece 382 is pressure welded to the upper surface of the spring receiving projection 375 of the release actuating member 37 (Refer to FIGS. 12 and 15).

Thereby, an assembly of the childproof lock mechanism 22 is completed, and the release actuating member 37 is kept in a state of being constantly urged toward the standby position where is the lower end of the elongated guide hole 366 by the downward urging force of the torsion coil spring 38.

In addition, if the torsion coil spring 38 is assembled, since the other side foot piece 382 close to the inner surface of the auxiliary lever part 362, there is no possibility that the other side foot piece 382 will get out of the spring receiving projection 375 (refer to FIG. 13).

Figure 4:
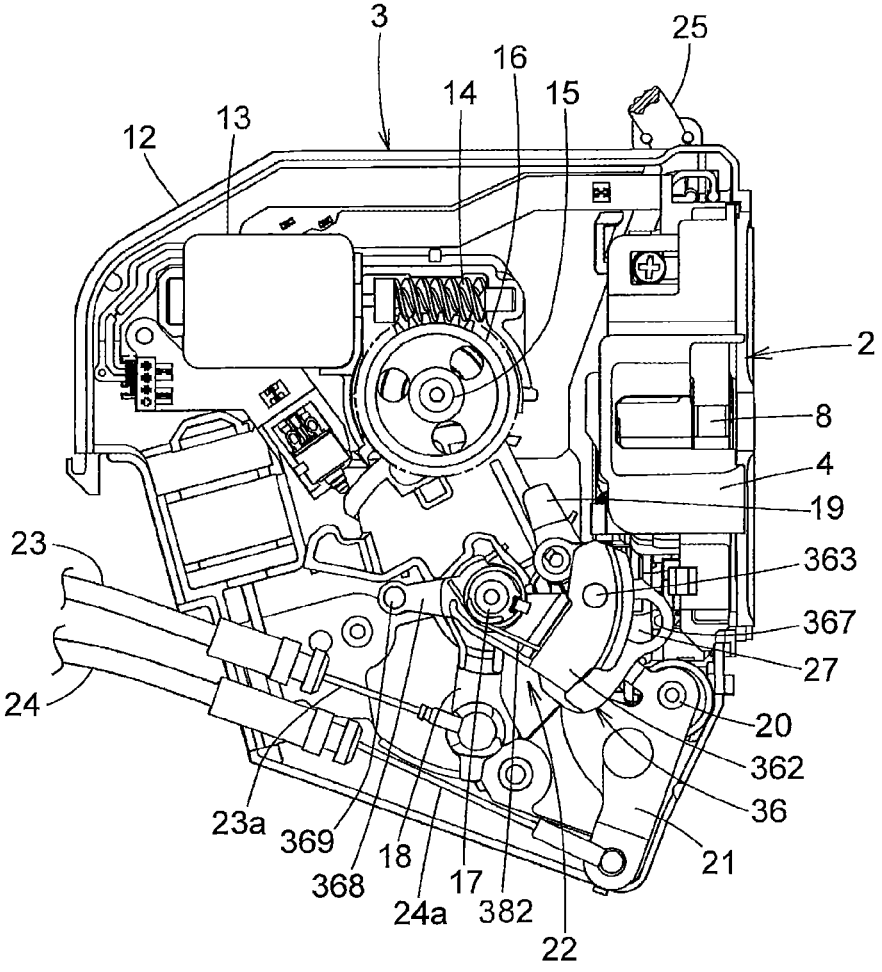
FIG. 4 is a side view of the door latch apparatus with the childproof lock mechanism that a cover of which is removed, seen from inside a vehicle.

In this way, the childproof lock mechanism 22 assembled to the subassembly state beforehand can be assembled easily in the housing 12, as shown in FIG. 4, after pivotally supporting the lock/unlock lever 18 of the childproof lock mechanism by the shaft 17 and the inside lever 21 by the shaft 20 in the housing 12 respectively, and then fitting the shaft hole 361 formed in the childproof lever 36 to the shaft 17 from inner direction of the vehicle.

Namely, mentioned as above, since the motor 13, various levers, etc. and the childproof lock mechanism 22 can be assembled in the housing 12 from the inner direction of the vehicle (a certain direction), an automatic assembly of each parts in an assembly line etc. becomes possible, so that the assembly efficiency of the door latch apparatus 1 improves.

Figure 16:
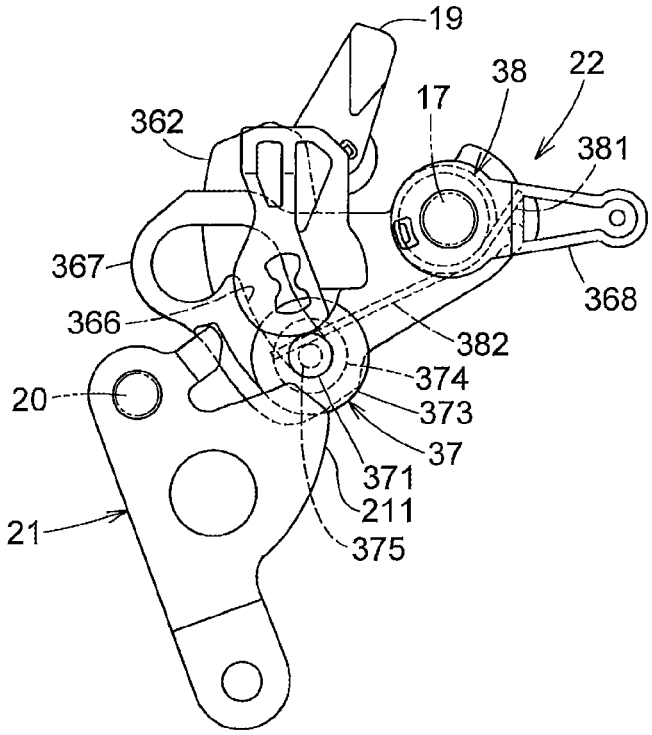
FIG. 16 is an enlarged side view of the childproof lever, the inside lever and the release lever, when the childproof lever is in the childproof unlocking state, seen from outside the vehicle.

In this way, when the childproof lock mechanism 22 is assembled in the housing 12 in this manner, as shown in FIG. 16 that is a side view seen from the direction of the outer side of the vehicle, it is in the state that the projecting portion 371 of the release actuating member 37 is positioned below and near the release lever 19, and below and near the projecting portion 371, the tip part of the active opening portion 211 of the inside lever 21 comes to be positioned.

Next, the action of the childproof lock mechanism 22 is explained with reference to FIGS. 16 to 20.

FIG. 16 shows a state that the childproof lever 36 of the childproof lock mechanism 22 is rotated to the childproof unlocking position (the position shown in FIG. 4), and the childproof lock mechanism 22 is in the childproof unlocking state.

In this case, the projecting portion 371 of the release actuating member 37 biased by the standby position is moved in the release lever 19 direction and enters to the rotate locus at the tip of the active opening portion 211 of the inside lever 21. Namely, while the projecting portion 371 of the release actuating member 37 is moved to the lower part near the lower end of the release lever 19, the tip part of the active opening portion 211 of the inside lever 21 is located below and near the projecting portion 371. In addition, the childproof lever 36 rotated at the childproof unlocking position is stopped and held at that position as follows.

Figure 14:
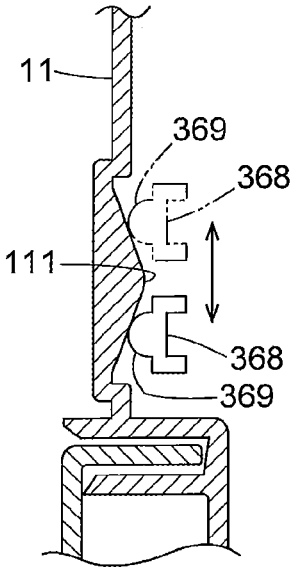
FIG. 14 is an enlarged sectional view taken along the line XIV-XIV in FIG. 3.

As shown in FIGS. 8 and 14, in the childproof lever 36, a front extending portion 368 extending forward from the vicinity of the formation part of the shaft hole 361 in the shape of tapering is formed, and on the side of the tip part (front end portion) on the vehicle inner side of this front extending portion 368, a stopped portion 369 of hemispherical shape is protruded. On the other hand, on the side of outer side of the vehicle of the cover 11, a mountain shaped stop part 111 where the stopped portion 369 can get over and can move up and down is formed.

As shown in FIG. 14 as a solid line, when the childproof lever 36 rotates to the childproof unlocking position, the stopped portion 369 moves over the top part of the mountain shaped stop part 111 and further move downwards, and as the upward movement is prevented, the childproof lever 36 is stopped and held at the childproof unlocking position.

On the other hand, when the childproof lever 36 is rotated to the childproof locking position (a clockwise direction in FIGS. 4 and 15), as shown in FIG. 14 with a two-point chain line, the stopped portion 369 overcomes the top part of the mountain shaped stop part 111 and further moves upward thereby the downward movement is prevented, so that the childproof lever 36 is stopped and held at the childproof locking position.

Figure 17:
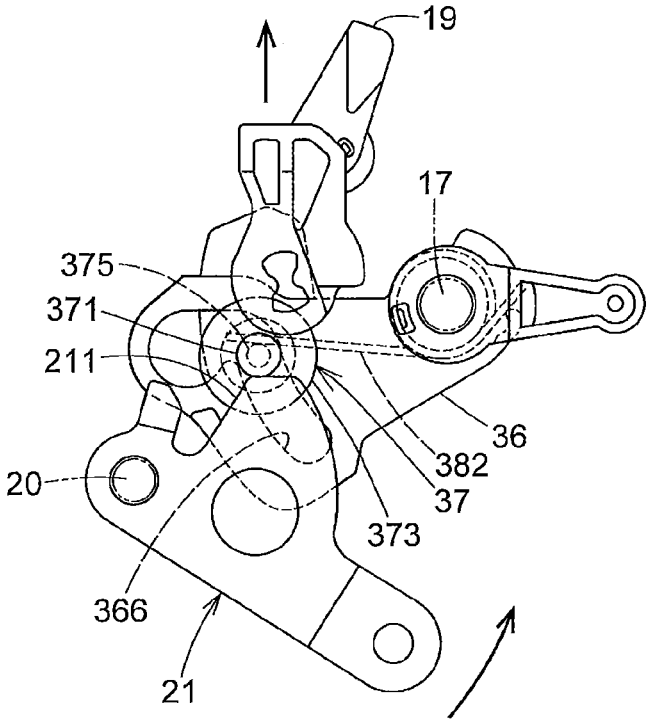
FIG. 17 is a side view of the childproof lever, when opening the inside lever, in the state of FIG. 16.

As shown in FIG. 17, in the above-mentioned childproof unlocking state and when the lock/unlock lever 18 is in the unlocking position (the position shown in FIG. 4), based on the door opening operation of the inside handle, If the inside lever 21 rotates to the opening direction (a clockwise direction in FIGS. 4 and 15) shown by an arrow, the tip of the active opening portion 211 of the inside lever 21 abuts with the projecting portion 371 entering into the rotate locus from the lower side, then the projecting portion 371 is moved to upward direction which is the opening direction, then the release actuating member 37 biased in the standby position of the lower end of the elongated guide hole 366 is moved to the upper release position along with the elongated guide hole 366 against the biasing power of the torsion coil spring 38.

Thereby, the release lever 19 is moved to the above release position through the projecting portion 371, then the upper end of the release lever 19 abuts with the pawl 10, and the opening operation of the inside lever 21 is transmitted to the meshing mechanism which comprises the pawl 10 and latch 8, so that the door can be opened from the vehicle inner side.

When the door opening operation is stopped halfway, the release actuating member 37 is returned to the standby position of the lower end by the downward biasing power of the torsion coil spring 38, without stopping in the middle of the elongated guide hole 366.

Still more, because the release actuating member 37 is biased downward by the torsion coil spring 38, when the release actuating member 37 is moved upward along with elongated guide hole 366, the bias force also acts on the childproof lever 36 to rotate it clockwise in FIG. 16, (a counterclockwise direction in FIGS. 4 and 15). However, as shown in FIG. 1, since the manual operation part 363 of the childproof lever 36 is penetrated the vertical elongated hole 39 formed in the cover 11 and abuts with or close to the upper end of the vertical elongated hole, it is prevented that the childproof lever 36 rotates counterclockwise direction in FIGS. 4 and 15, and the release actuating member 37 is moved certainly upwards along the elongated guide hole 366.

Moreover, if the downward biasing power of the release actuating member 37 by the torsion coil spring 38 is reduced, the release actuating member 37 can be moved more reliably upward along the elongated guide hole 366.

Figure 18:
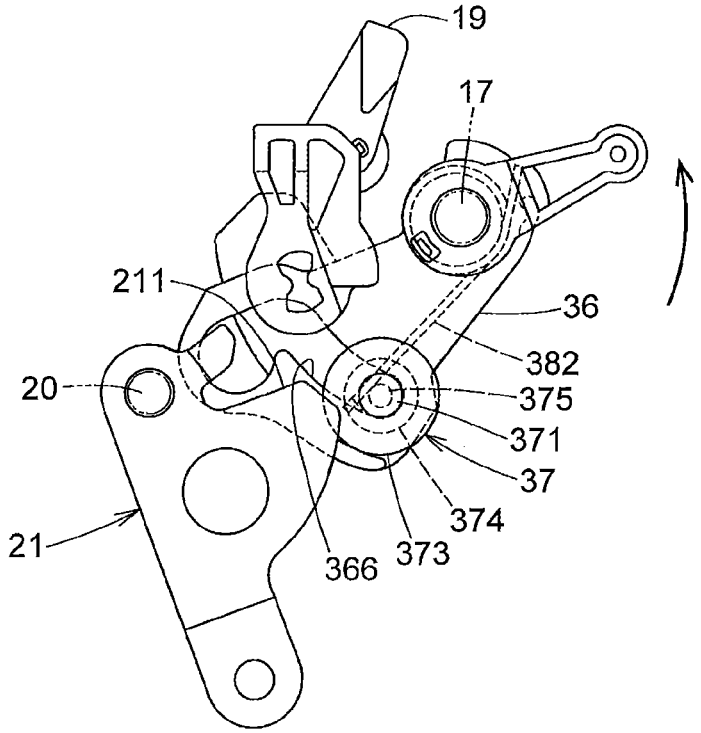
FIG. 18 is an enlarged side view of the childproof lever, the inside lever and the release lever, when the childproof lever is in the childproof locking state, seen from outside the vehicle.

As shown in FIG. 18, if the childproof lever 36 is rotated in the counterclockwise direction (a clockwise direction in FIGS. 4 and 15) to the childproof locked position and the childproof lock mechanism 22 is made into the childproof locking state, the projecting portion 371 of the release actuating member 37 in the standby position of the lower end of the elongated guide hole 366 retreats from the rotate locus at the tip of the active opening portion 211 of inside lever 21.

Figure 19:
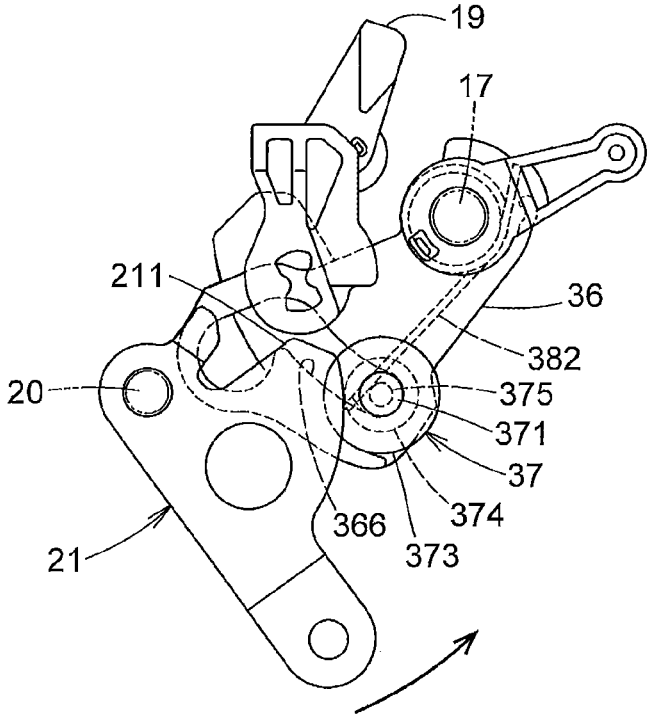
FIG. 19 is a side view of the childproof lever, when opening the inside lever, in the state of FIG. 18.

As shown in FIG. 19, in above-mentioned childproof locking state, even if the inside handle is operated to open the door and the inside lever 21 rotates in the opening direction shown by an arrow, the tip of the active opening portion 211 does not abuts with the projecting portion 371, but will be in a swing away state. Thereby, the release lever is not moved to the upper release position through the projecting portion 371, and the opening operation of the inside lever 21 is set to be unable to transmit to the meshing mechanism containing the pawl 10 and the latch 8, so that it becomes unable to open the door from the vehicle inner side.

Figure 20:
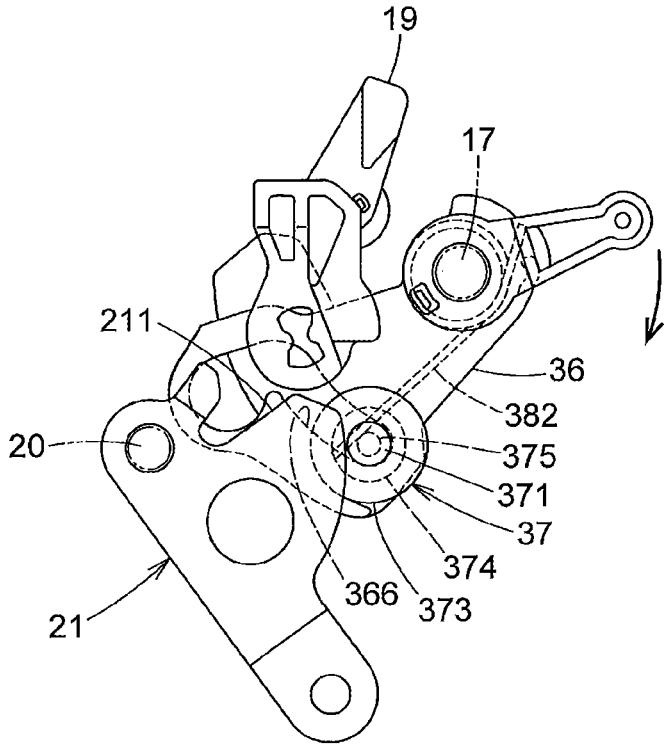
FIG. 20 is a side view of the childproof lever, when going to change the childproof lever to the childproof unlocking state, in the state of FIG. 19.

In addition, although it is not done by normal operation, in the state which is shown in FIG. 19, if it is attempted to rotate the childproof lever 36 further to the childproof unlocking position while the opening operation of the inside handle is maintained (in the state where the inside lever 21 is rotated in the opening direction), as shown in FIG. 20, since the projecting portion 371 of the release actuating member 37 abuts with the active opening portion 211 of the inside lever 21, so that the childproof lock mechanism 22 is maintained in the childproof locking state.

As explained above, in the door latch apparatus of the above-mentioned embodiment, the childproof lock mechanism 22 comprises the childproof lever 36 rotatable to the childproof unlocking position and the childproof locking position, the release actuating member 37 which is movably supported in the elongated guide hole 366 provided in the childproof lever 36 and has the projecting portion 371 which can transmit the opening operation of the inside lever 21 to the meshing mechanism, and the torsion coil spring 38 which always biasing the release actuating member 37 in the standby position. Wherein, the release actuating member 37 including the projecting portion 371 is formed separately from the childproof lever 36, so that only the release actuating member 37 containing the projecting portion 371 is movable independently in the release direction in conjunction with the opening operation of inside lever 21.

Therefore, it is not necessary to secure a space in the housing 12 in which the projecting portion 371 rotates in the release direction with the childproof lever 36, in the same way as the prior art, so that, regarding to the lock/unlock lever 18 and the release lever 19 which are incorporated in the housing 12 adjacent to the childproof lever 36, the degree of freedom in arrangement and design of the device is increased.

Moreover, since the childproof lever 36, the release actuating member 37, and the torsion coil spring 38 constituting the childproof lock mechanism 22 are assembled into the subassembly state in advance, and the childproof lock mechanism 22 can be assembled in the housing 12 from the same direction as the assembling direction of other parts, so that the assembly efficiency of the door latch apparatus in an automatic assembly line etc. can be improved.

In addition, as assembling method of the childproof lock mechanism 22 in the subassembly state, besides the method mentioned above that is fitting on the shaft 17 of the lock/unlock lever 18, there is also another method of assembling the childproof lock mechanism to the cover 11.

Figure 21:
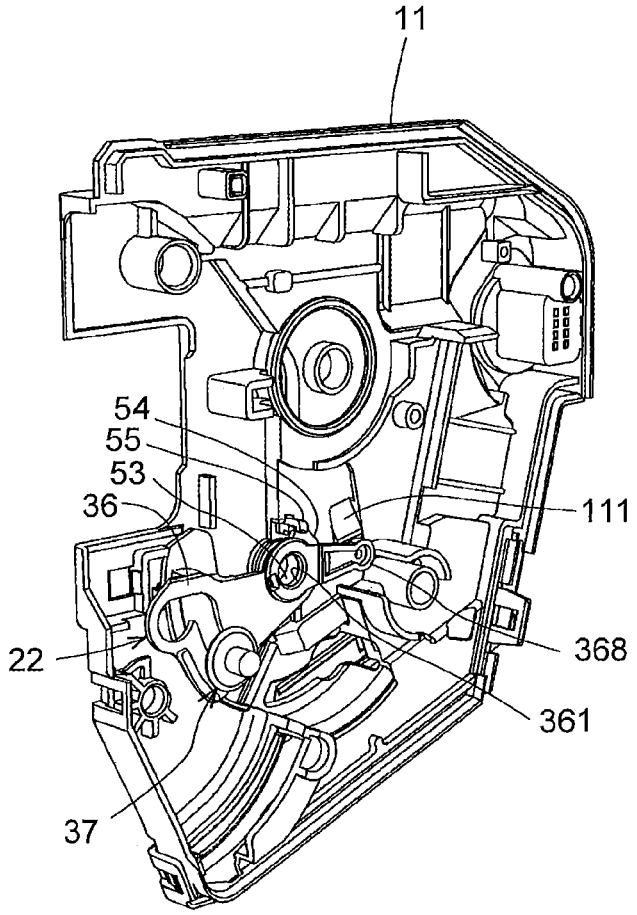
FIG. 21 is a perspective view of another embodiment of the present invention that the childproof lock mechanism is assembled to the cover, seen from outside the vehicle.

Namely, as shown in FIG. 21, on the side surface of the outer side of the vehicle of the cover 11, (a side opposite to the housing 12), a shaft 53 is protruded so that the shaft 53 is the same axle with the shaft 17 of the lock/unlock lever 18, and the shaft hole 361 of the childproof lever 36 is fitted to this shaft 53, so that the childproof lock mechanism 22 can be assembled to the cover 11.

Further, to prevent the childproof lock mechanism 22 from disengaging from the shaft 53, it is better that a projecting portion 54 provided in the portion near the shaft hole 361 of the childproof lever 36 is held by a holding portion 55 which is protruded in the cover 11.

In this way, by assembling the childproof lock mechanism 22 in the subassembly state to the cover 11, since at the same time the cover 11 is equipped with the housing 12, the childproof lock mechanism 22 can also be installed in the housing 12 from the same direction as the mounting direction of the cover 11, assembly efficiency of the door latch apparatus is improved.

Although embodiments of the present invention are explained as above, within the limits which does not deviate from the summary of the present invention, it is possible to give following various modification and change to the embodiment.

With the above-mentioned embodiments, the auxiliary lever part 362 is formed in the childproof lever 36 and the manual operation part 363 is integrally formed to this auxiliary lever part 362. However, the auxiliary lever part 362 may be omitted and the manual operation part 363 can also be formed in the childproof lever 36 itself. When the auxiliary lever part 362 is omitted, contrary to the above embodiment, the large flange part 373 on the side of the projecting portion 371 is made a small diameter, so that the release actuating member 37 can be assembled to the elongated guide hole 366 from inner direction of the vehicle.

With moreover, in the above embodiments, although the release actuating member 37 is assembled to the childproof lever 36, by engaging the small flange part 374 of the release actuating member 37 with the enlarged diameter hole part 367 provided in the childproof lever 36, the enlarged diameter hole part 367 may be omitted. Instead of the enlarged diameter hole part 367, by extending the end of the release position of the elongated guide hole 366 on the release position side to the rear end of the hole 36 to form an extended opening, and the release actuating member 37 can be assembled by fitting the guided shaft portion 372 through the opening end of the opening to the elongated guide hole 366. In this case, the outside diameter of the large flange part 373 and the small flange part 374 can be made equal.

With furthermore, in the above embodiment, the guide part provided in the childproof lever 36 is the elongated guide hole 366. Instead of the elongated guide hole, for example, while in the childproof lever 36 on the side surface of the vehicle exterior side, an arcuate recess in which having a pair of grooves-shaped guide grooves facing each other can be provided, and on the other hand, in the release actuating member 37, a pair of guided parts projecting in opposite directions each other on the side surface opposite to the projecting portion 371 can be provided. Thereby, the pair of guided parts of the release actuating member 37 may be movably fitted in the pair of guide grooves in the arcuate recess. In this case, the torsion coil spring 38 is arranged on the outer side of the vehicle of childproof lever 36, and the other side foot piece 382 is pressure welded to the proper place of the release actuating member 37.

What is claimed is:

1. A door latch apparatus comprising:

a housing whose opening surface on a vehicle inner side is covered by a cover;

an inside lever operable in an opening direction in accordance with a door opening operation of an inside handle provided in the vehicle inner side; and a childproof lock mechanism configured to be switched between a childproof unlocking state where an opening operation of the inside lever is transmitted and a childproof locking state where the opening operation of the inside lever is not transmitted, the childproof lock mechanism comprising a childproof lever supported by the housing and rotatable to a childproof unlocking position and a childproof locking position, an auxiliary lever part provided integrally with the childproof lever, the auxiliary lever part facing an inner side surface of the childproof lever at a predetermined dimension apart from the vehicle inner side, a release actuating member which is supported in an elongated guide hole provided in the childproof lever movably from a standby position to a release position, the release actuating member having a projecting portion configured to enter to a rotate locus of the inside lever in the opening direction when the childproof lever is in the childproof unlocking position, the projecting portion being configured to retreat from the rotate locus of the inside lever when the childproof lever is in the childproof locking position, and a torsion coil spring configured to always bias the release actuating member toward the standby position, wherein the release actuating member is configured such that, when the childproof lever is in the childproof unlocking position and when the inside lever is in the opening operation, the release actuating member moves to the release position against the biasing power of the torsion coil spring, by the projecting portion being brought into abutment with the inside lever and being moved in the opening direction, and wherein the release actuating member comprises a guided shaft portion formed in an opposite side of a projection direction of the projecting portion and movably fitted in the elongated guide hole, and a spring receiving projection that protrudes in a direction opposite to the protruding direction of the projecting portion and in a gap between the childproof lever and the auxiliary lever part, one of foot pieces of the torsion coil spring contacting the spring receiving projection by pressure.

2. An assembling method for assembling the childproof lock mechanism according to claim 1 to the housing of the door latch apparatus, the method comprising:

assembling the release actuating member to the elongated guide hole of the childproof lever, assembling the torsion coil spring to the childproof lever, and holding the release actuating member in the biased state in the standby position, thereby changing the childproof lock mechanism into a subassembly state; and assembling the childproof lock mechanism in the subassembly state to the housing.

3. An assembling method for assembling the childproof lock mechanism according to claim 1 to the housing of the door latch apparatus, the method comprising:

assembling the release actuating member to the elongated guide hole of the childproof lever and assembling the torsion coil spring to the childproof lever and holding the release actuating member in the biased state in the standby position, thereby changing the childproof lock mechanism into a subassembly state;

assembling the childproof lock mechanism in the subassembly state to a shaft provided on a surface of the cover facing the housing; and assembling the childproof lock mechanism to the housing with the cover.

* * * * *